United States Patent [19]

Rhodes

[11] Patent Number: 5,042,997

[45] Date of Patent: Aug. 27, 1991

[54] AIR CONTROL SYSTEM PROVIDING HEALTHFUL ENCLOSED ENVIRONMENT

[76] Inventor: James A. Rhodes, 42 East Gay St., Suite 1300, Columbus, Ohio 43215

[21] Appl. No.: 585,513

[22] Filed: Sep. 20, 1990

Related U.S. Application Data

[63] Continuation-in-part of Ser. No. 558,515, Jul. 27, 1990, abandoned.

[51] Int. Cl.[5] ..... B03C 3/01; B01D 53/04; B01D 46/00

[52] U.S. Cl. ..... 55/126; 55/213; 55/217; 55/316; 55/385.2; 98/1.5; 236/44 C

[58] Field of Search ..... 55/20, 126, 21, 213, 55/215, 217, 316, 487, 385.2; 98/1.5; 236/44 C

[56] References Cited

U.S. PATENT DOCUMENTS

| | | | |
|---|---|---|---|
| 4,141,703 | 2/1979 | Mulchi | 55/316 |
| 4,552,058 | 11/1985 | Wooldridge | 98/1.5 |
| 4,604,111 | 8/1986 | Natale | 55/385.2 X |
| 4,737,173 | 4/1988 | Kudirka et al. | 55/316 X |
| 4,850,264 | 7/1989 | Kiser | 98/1.5 |
| 4,854,949 | 8/1989 | Giles et al. | 55/126 |

*Primary Examiner*—Charles Hart

*Attorney, Agent, or Firm*—Antonelli, Terry, Stout & Kraus

[57] ABSTRACT

An environmental control system providing a healthful environment in an enclosed structure for people living, working, travelling, or spending leisure time in the structure. The environmental control system may include a heating, ventilating and air conditioning unit, for controlling the temperature and humidity of air within the structure and pressurizing the interior of the structure, and an air cleaning system. The air cleaning system preferably includes a pre-filter unit to remove larger particulates, a medium efficient extended surface type filter device for capturing smaller particulates, a chemical and/or activated carbon filter device to provide gas phase air purification and scrubbing, and a high efficient particulate air filter device. If desired, an electronic air filter device can be included. An air quality measuring unit monitors the cleanliness of the air passing from the system. Pressure measuring devices may be installed across each filter unit so that the need to clean or replace a particular filter unit can be determined from a higher than normal pressure drop across the unit.

20 Claims, 2 Drawing Sheets

AIR CONTROL SYSTEM PROVIDING HEALTHFUL ENCLOSED ENVIRONMENT

CROSS-REFERENCE TO RELATED APPLICATION

This application is a continuation-in-part of U.S. Pat. application Ser. No. 07/558,515, filed July 27, 1990 and now abandoned.

BACKGROUND OF THE INVENTION

The present invention pertains to an environmental control system to provide a healthful enclosed environment for people living, working, travelling, or otherwise spending time in an enclosed structure. The environmental control system enables people to avoid temperature extremes, undesirable humidity levels, polluted air, sudden variations in barometric pressure, and other conditions which are detrimental to the health and well being of the inhabitants.

Many people desire or require a healthful, controlled environment in which to live, work, travel, and engage in leisure activities. This is particularly true of older people and of people having health problems such as allergies, respiratory problems, circulatory problems, arthritis, or rheumatism. As recognized in, for example, *The Columbia University College of Physicians and Surgeons Complete Home Medical Guide,* Donald F. Tapley, M.D., editor, 1988, indoor air pollutants include ozone, carbon oxides, nitrous oxide, formaldehyde, and aerosol propellants, all of which have been found to cause health problems. The problems many people experience from allergies are well known. The "Cover Story" titled "Now's a very hopeful time for sufferers" found at page 1A of the May 9, 1990 *USA Today* describes such problems and the efforts made to avoid or overcome them.

It is a common practice to control the temperature and humidity of the air within an enclosed structure and to provide a mechanical or an electronic filter to remove pollen and particulates from the air. However, other impurities also are frequently found in the air. By way of example, as reported in "Indoor Ozone Exposures," by Charles J. Weschler, Helen C. Shields, and Datta V. Noik, *The Journal of the Air & Waste Management Association,* volume 39, No. 12, Dec. 1989, pages 1562–1568, studies have found that for many people indoor ozone exposure (i.e. concentration times duration of exposure) is greater than outdoor ozone exposure Undesirable levels of nitrogen oxides are also sometimes encountered inside buildings and other enclosed structures. Thus, it is desirable to reduce or control these and other forms of pollution from the air. Further, such humidity control has generally not provided optimum humidity levels for extended periods of time over varying temperatures. Medical experience indicates, for example, that a majority of the persons suffering from arthritis have less discomfort if they are able to remain for extended periods of time in an atmosphere with a humidity level in the range of from about 35% to about 55%.

SUMMARY OF THE INVENTION

The present invention is an environmental control system suitable for incorporation into any of various structures. As one example, the environmental control system of the present invention can be incorporated into a building having any of numerous uses, including use as a commercial building, an office building, or as a residential building, either a single family residence or an apartment building. The building has a set of outer walls and a roof forming the outer building perimeter and defining the building exterior and interior. The outer walls have at least one access opening to permit personnel to enter and leave the building. The interior can be provided with interior walls and/or one or more floors so that the building comprises a multi-unit, and/or multi-storey building. As another example, the environmental control system can be incorporated into a vehicle such as an ocean liner, a bus, a railway passenger car, a car or truck.

The environmental control system assures a healthful enclosed environment. The environmental control system preferably includes a heating, ventilating, and air conditioning unit capable of controlling the temperature and humidity within the enclosed structure and capable of pressurizing the interior of the enclosed structure, and an air cleaning system. The air cleaning system comprises an air supply fan, measuring devices, and various types of filters to trap, adsorb, absorb and attach pollutants from the air stream. The air cleaning system has the capability of cleaning in the order of about 99.9% of particles as small as 0.12 micron from the air, including dust, bacteria, mold, pollen, plant spores, lung damaging particles, yeast cells and many viruses. It also controls noxious gases such as nitrogen oxides, oxidants including ozone, sulfur dioxide, and chemical fumes such as formaldehyde.

The air cleaning system includes a fan with sufficient capacity to force air through the filter units and to overcome the static pressures created by the filter units. A pre-filter unit is included to remove larger particulates, which comprise a substantial portion of the contaminants. Generally, the pre-filter is formed of a fibrous material in the form of a pad which, when it has collected its dust load, can be discarded and replaced. A suitable pre-filter unit is available from American Air Filter Company.

A medium efficient (50%–90%) filter media device is included and preferably is of the extended surface type so that the air comes in as much contact with the media as possible. Various types of dust absorbing material can be used. A suitable filter device of this type is available from Farr Company. A chemical and/or activated carbon filter device is provided downstream of the medium efficient filter media device. This filter device utilizes a chemisorbant filter medium. As air is passed through this filter device, a combination of gas phase air purification and scrubbing adsorbs and/or absorbs impurities and improves the air quality. A suitable chemical/activated carbon filter device is available from Purafil Inc.

To capture microscopic particles as small as 0.12 micron from the air stream, a high efficiency particulate air (HEPA) filter device is installed downstream of the chemical/activated carbon filter device. The HEPA filter device is made in an extended surface area configuration of deep space folds of submicron glass fiber paper. A suitable HEPA filter device is available from Cambridge Filter Company.

An electronic air filter device may be included, if desired. By using electrostatic precipitation, this filter device removes microscopic particulates. The electronic filter device consists of an ionization section and a collecting plate section. Frequent cleaning of the electronic filter device is desirable and is accomplished either by removing the cells or by means of a self-contained washing system.

An air quality measuring unit monitors the cleanliness of the air passing from the system, for example photoelectrically. To maintain the highest efficiency possible with the filtering system, pressure drop measuring devices are installed across each type of filter device so that the need to clean and/or replace components of a particular filter device can be determined from a higher than normal pressure drop across the unit.

BRIEF DESCRIPTION OF THE DRAWINGS

These and other aspects and advantages of the present invention are more apparent in the following detailed description and claims, particularly when considered in conjunction with the accompanying drawings in which like parts bear like reference numerals. In the drawings:

DETAILED DESCRIPTION OF A PREFERRED EMBODIMENT

Figure 1:
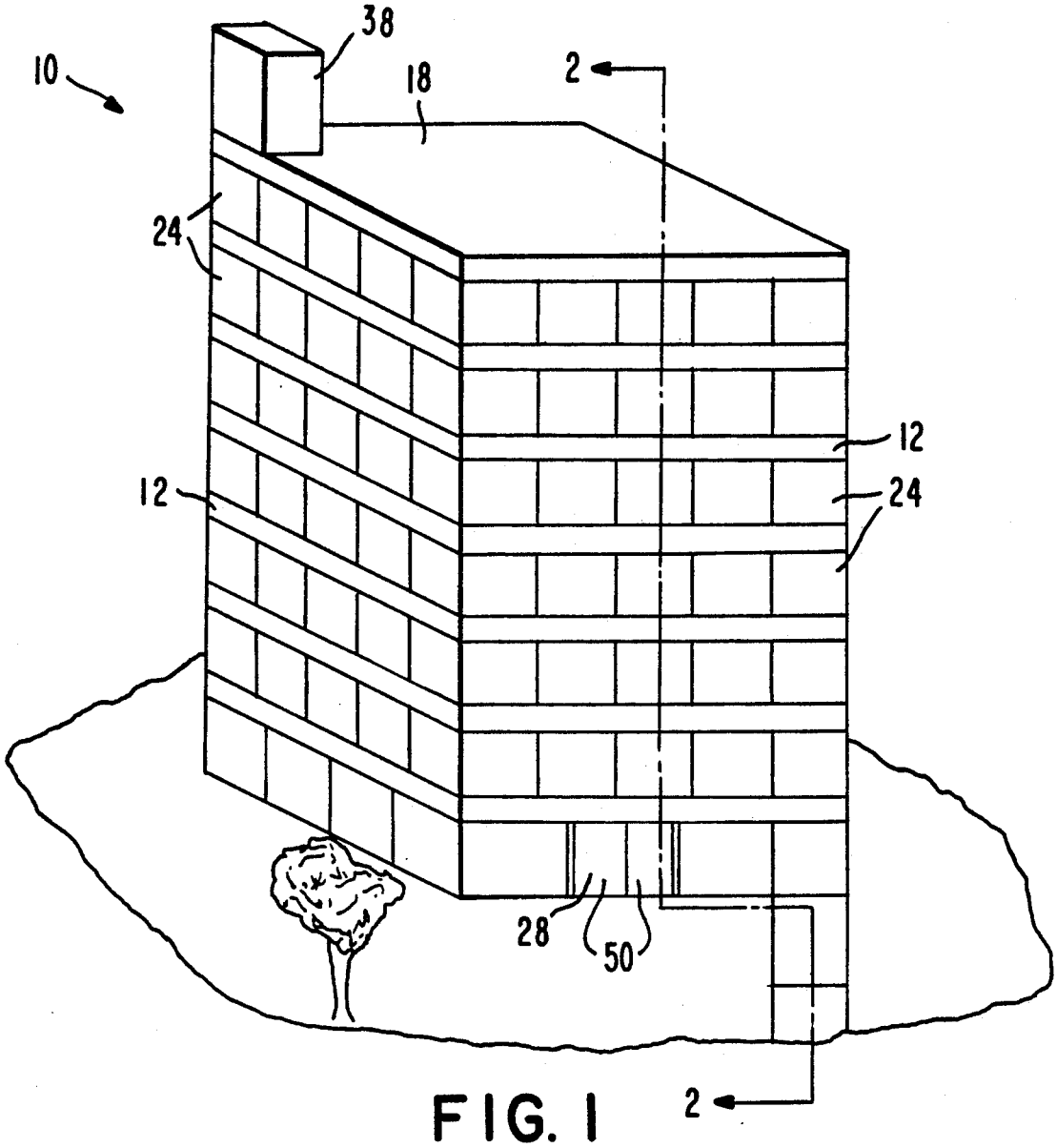
FIG. 1 is a perspective view of a building incorporating an environmental control system in accordance with the present invention.
Figure 2:
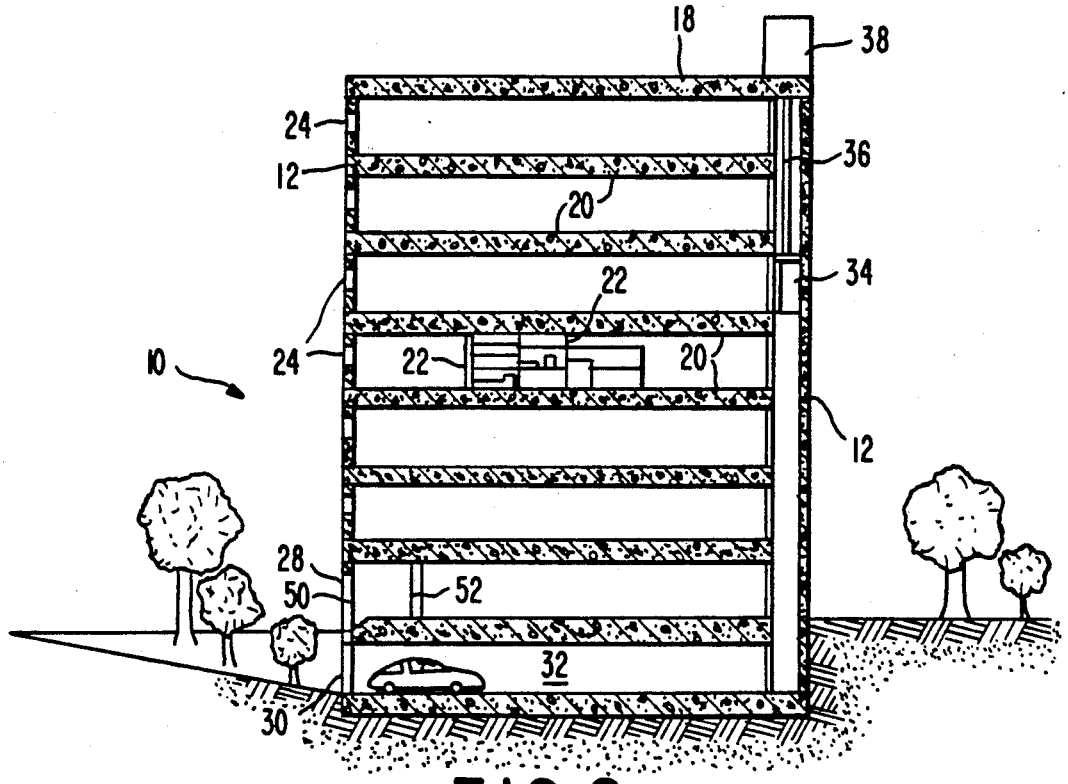
FIG. 2 is a sectional view of the building, taken along line 2—2 of FIG. 1.

FIG. 1 depicts a building 10 incorporating an environmental control system in accordance with the present invention. By way of examples, building 10 might be an apartment building, a commercial building, or a professional or office building. As seen in FIGS. 1 and 2, building 10 includes a set of outer walls 12 forming the outer building perimeter and defining the building exterior. A substantially rigid roof 18, which can be of conventional design, is supported by outer walls 12 and, in cooperation with the outer walls, defines the building interior. A number of floors 20 can be positioned at different vertical levels within the interior of building 10. As illustrated by the fourth floor of building 10 in FIG. 2, each floor can be provided with several walls 22 so that the floors 20 and walls 22 define the building as a multi-storey, multi-unit building. Alternatively, building 10 can be a single storey building or a single unit building, or both. A number of windows 24 can be provided in outer walls 12 at each floor 20 of the building. A personnel entrance 28 is provided through one of the outer walls 12 at the ground floor level to permit people to enter and leave building 10. If desired, a vehicle entrance 30 can also be provided, for example to a basement level garage 32.

FIG. 2 depicts an elevator car 34 moving vertically adjacent one outer wall 12 to provide access to the several floors 20 of building 10. Elevator car 34 is suspended and controlled by cables 36 which connect to equipment within penthouse 38 on roof 18. Of course, the elevator system can be located more centrally in the building interior, and another type of elevator, such as a hydraulic jack type, might be utilized, if desired.

Figure 3:
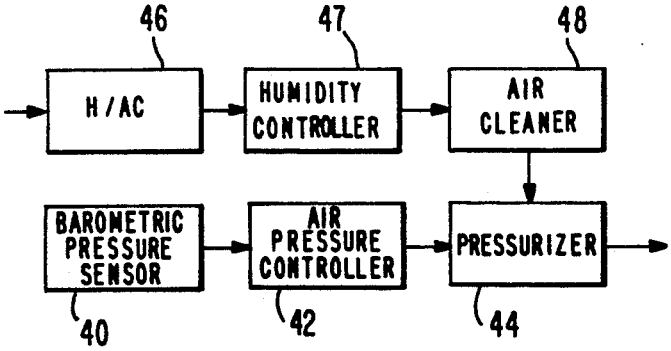
FIG. 3 is a block diagram of a preferred embodiment of an environmental control system in accordance with the present invention.

FIG. 3 is a block diagram of an environmental control system in accordance with a preferred embodiment of the present invention which is suitable for incorporation into a structure such as building 10. A barometric pressure sensor 40 senses the ambient atmospheric pressure outside building 10 and provides an indication of that atmospheric pressure to controller 42. Pressurizer 44, which can be a conventional fan for the building heating, ventilating, and air conditioning system, is controlled by controller 42 to maintain the air pressure within building 10 at the desired level. If desired that interior air pressure can be maintained slightly above the exterior ambient atmospheric pressure, as disclosed in U.S. Pat. No. 4,608,785, the disclosure of which is incorporated herein by reference.

A heating and air conditioning unit 46 is connected through humidity controller 47 and an air cleaner 48 to pressurizer 44. Air which has had its temperature controlled by H/AC unit 46 and its moisture content controlled as necessary by humidity controller 47 to be within the range of from about 35% to about 55%, is cleaned by air cleaner 48 to remove in the order of about 99.9% of the impurities from the air, and the thus treated air is then fed to pressurizer 44. Controller 42 controls pressurizer 44 to maintain the air pressure within building 10 slightly above ambient atmospheric pressure, while distributing the heating and/or cooling air within the interior of building 10. Windows 24 preferably are closed, thereby maintaining the pressure differential. However, because building 10 is not air tight, the air pressure differential between the building interior and ambient atmospheric pressure results in a substantially continuous flow of air from the building to the outside of the building. This inhibits entry of pollen or other pollutants into the building.

To maintain the pressure difference between the interior of building 10 and ambient atmospheric pressure, one or more air locks is provided. For this purpose, entrance 28 to building 10 can include a first set of doors 50 and a second set of doors 52. If desired, one or both of the sets of doors 50, 52 can be a revolving door. Alternatively, if desired, the interior of elevator car 34 can serve as an air lock, as shown in U.S. Pat. No. 4,637,176, the disclosure of which is incorporated herein by reference. In that event, the pressure within the interior of elevator car 34 can be increased above atmospheric pressure as the elevator car leaves basement level 32 and can be returned closer to atmospheric pressure as elevator car 34 returns to basement level 32. The parking garage and/or other facilities within basement level 32 can be at ambient atmospheric pressure, if desired.

Figure 4:
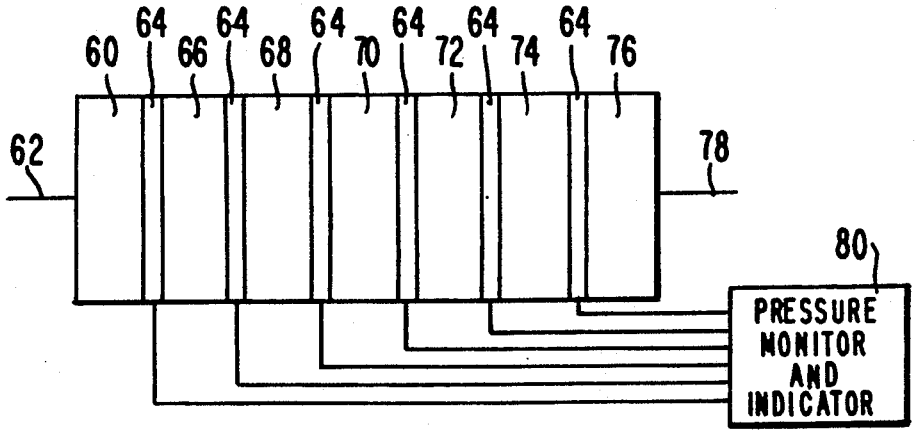
FIG. 4 is a block diagram of an air cleaning system suitable for use within the environmental control system of FIG. 3 in accordance with the present invention.

FIG. 4 is a block diagram depicting an air cleaning system suitable for use as air cleaner 48 within the environmental control system of the present invention. Fan 60 forces air from inlet 62 through pre-filter unit 66. The pre-filter unit removes larger particulates from the air and passes the air to medium efficient air filter device 68 which is an extended surface type air filter permitting the air to contact as large a surface of the filter media as possible From filter device 68, the air is passed to a chemical and activated carbon filter device 70 in which additional impurities are removed. Next the air passes through a high efficiency particulate air filter device 72 in which microscopic particles are captured. If desired, the air can then be passed through electronic air filter device 7 in which further microscopic particulates, such as pollen, are removed by electrostatic precipitation. From high efficiency particulate air filter device 72, or from electronic air filter device 74 if it is used, the treated air passes via outlet 78 to pressurizer 44. Measuring unit 76 monitors the cleanliness of the discharged air. The serial combination of filter devices 66, 68, 70, 72, and 74 removes in the order of about 99.9% of the impurities from the air, leaving the air suitable for the environmentally controlled building of the present invention.

Preferably, an air pressure measuring device 64 is provided on each side of each filter device 66–74 to provide an indication of the air pressure entering and leaving the filter unit, as depicted in FIG. 4. These indications are monitored, and the pressure drop across each filter device is indicated by unit 80. When the pressure drop across a filter device exceeds a predetermined amount, the components within that device can be cleaned or replaced, as needed.

Figure 5:
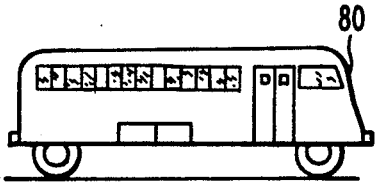
FIG. 5 is a perspective view of a motor vehicle incorporating an environmental control system in accordance with the present invention.
Figure 6:
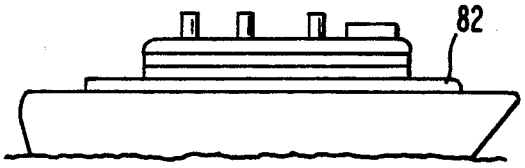
FIG. 6 is a perspective view of an ocean liner incorporating an environmental control system in accordance with the present invention.
Figure 7:
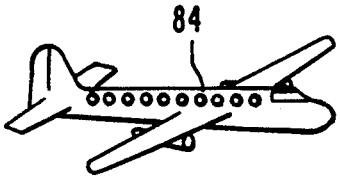
FIG. 7 is a perspective view of an airplane incorporating an environmental control system in accordance with the present invention.

The environmental control system of FIG. 3 can be utilized to control the environment within structures other than buildings. Thus, for example, the environmental control system might be utilized to control the environment within a motor vehicle such as bus 80 depicted in FIG. 5, a boat or ship, such as ocean liner 82 depicted in FIG. 6, or an airplane 84 depicted in FIG. 7, or within any other structure.

Although the present invention has been described with reference to a preferred embodiment, modifications and rearrangements can be made, and still the result would be within the scope of the invention.

What is claimed is:

1. An environmentally controlled building, comprising:

an outer wall defining an outer building perimeter and having at least one fenestration therethrough for passage of personnel;

a roof supported by and cooperating with said outer wall to define a building exterior and interior; and an environmental control system for controlling the environment within said building interior, said environmental control system including a heating and air conditioning unit, having an air inlet, for controlling the temperature of air drawing into said air control system; a humidity control unit, having an inlet connected to said heating and air conditioning unit, for controlling the humidity of air within said air control system; an air blower for forcing air from said environmental control system into said building interior; and an air filtering system having an inlet connected to said humidity control unit and an outlet connected to said blower, said air filtering system including a plurality of dissimilar air filtering devices connected to permit serial passage therethrough of air from said humidity control unit, for removing particulates and impurities from air passing therethrough, a plurality of air pressure sensing means, one air pressure sensing means on each side of each of said air filtering devices to sense the air pressure on each side of each of said air filtering devices, and means coupled to said air pressure sensing means for indicating the pressure drop across each of said air filtering devices.

2. A building as claimed in claim 1, wherein said plurality of air filtering devices include:

a prefilter unit having an inlet connected to said humidity control unit for filtering larger particulates from air discharged therefrom;

a medium efficient extended surface air filter device having an inlet connected to said prefilter unit for removing smaller particulates from air discharged therefrom;

a chemical air filter device having an inlet connected to said extended surface air filter device for adsorbing impurities from air discharged therefrom; and a high efficiency particulate air filter device having an inlet connected to said chemical air filter device for removing microscopic particulates from air discharged therefrom.

3. A building as claimed in claim 2, wherein said plurality of air filtering devices further include an electronic air filter device having an inlet connected to said high efficiency particular air filter device for electrostatic precipitation of microscopic particulates from air discharged therefrom.

4. A building as claimed in claim 1, wherein said blower comprises an air pressurization system for pressuring air discharged from said air filtering system and supplying the pressurized air to said building interior as substantially impurity free air.

5. A building as claimed in claim 4, further comprising:

pressure sensing means for sensing ambient atmospheric pressure outside said building; and pressure control means for controlling said air pressurization system to maintain the air pressure within said building interior at a predetermined relation with the ambient atmospheric pressure outside said building.

6. A building as claimed in claim 4, further comprising air lock means cooperating with said at least one fenestration for permitting personnel to enter and exit said building interior without substantial loss of air pressure from said building interior.

7. An environmental control system for an enclosed structure, said system comprising;

a heating and air conditioning unit, having an air inlet, for controlling the temperature of air drawn into said environmental control system;

an air blower for forcing air from said environmental control system to the interior of an enclosed structure; and an air filtering system having an inlet coupled to said heating and air conditioning unit and an outlet connected to said blower, said air filtering system including a plurality of dissimilar air filtering devices connected to permit serial passage therethrough of air from said heating and air conditioning unit, for removing particulates and impurities from air passing therethrough, a plurality of air pressure sensing means, one air pressure sensing means on each side of each of said air filtering devices to sense the air pressure on each side of each of said air filtering devices, and means coupled to said air pressure sensing means for indicating the pressure drop across each of said air filtering devices.

8. An environmental control system as claimed in claim 7, wherein said plurality of air filtering devices include:

a prefilter unit having an inlet connected to said humidity control unit for filtering larger particulates from air discharged therefrom;

a medium efficient extended surface air filter device having an inlet connected to said prefilter unit for removing smaller particulates from air discharged therefrom;

a chemical air filter device having an inlet connected to said extended surface air filter device for adsorbing impurities from air discharged therefrom; and a high efficiency particulate air filter device having an inlet connected to said chemical air filter device for removing microscopic particulates from air discharged therefrom.

9. An environmental system as claimed in claim 8, wherein said plurality of air filter devices further include an electronic air filter device having an inlet connected to said high efficiency particulate air filter device for electrostatic precipitation of microscopic particulates from air discharged therefrom.

10. An environmental control system as claimed in claim 7 further comprising a humidity control unit, having an inlet connected to said heating and air conditioning unit and an outlet connected to the inlet of said air filtering system, for controlling the humidity of air discharged from said environmental control system.

11. An environmental control system as claimed in claim 7, further comprising an enclosed structure; and means coupling said blower to the interior of said structure for discharging air from said environmental control system into the interior of said structure.

12. An environmental control system as claimed in claim 11, wherein said structure is a building.

13. An environmental control system as claimed in claim 11, wherein said structure is a vehicle.

14. An environmental control system as claimed in claim 13, wherein said vehicle is an ocean liner.

15. An environmental control system as claimed in claim 13, wherein said vehicle is an airplane.

16. An environmental control system as claimed in claim 13, wherein said vehicle is a motor vehicle.

17. An environmental control system as claimed in claim 16, wherein said motor vehicle is a bus.

18. An environmental control system as claimed in claim 11, wherein said blower comprises an air pressurization system for pressurizing air discharged from said air filtering system and supplying the pressurized air to the interior of said structure as substantially particulate and impurity free air.

19. An air filtering system for an environmental control system, said air filtering system comprising:

a prefilter device having an inlet for filtering larger particulates from air drawn thereinto;

a medium efficient extended surface air filter device having an inlet connected to said prefilter device for removing smaller particulates from air discharged therefrom;

a chemical air filter device having an inlet connected to said extended surface air filter device for adsorbing impurities from air discharged therefrom;

a high efficiency particulate air filter device having an inlet connected to said chemical air filter device for removing microscopic particulates from air discharged therefrom;

a plurality of air pressure sensing means, one air pressure sensing means on each side of each of said air filter devices to sense the air pressure on each side of each of said air filter devices; and means coupled to said air pressure sensing means for indicating the pressure drop across each of said air filter devices.

20. A system as claimed in claim 19, further comprising an electronic air filter device having an inlet connected to said high efficiency particulate air filter device for electrostatic precipitation of microscopic particulates from air discharged therefrom.

* * * * *